US006696093B2

(12) United States Patent
Ney et al.

(10) Patent No.: US 6,696,093 B2
(45) **Date of Patent: *Feb. 24, 2004**

(54) ALDEHYDE DONORS FOR STABILIZING PEROXIDES

(75) Inventors: Bill Ney, deceased, late of Glossop (GB), by Chris Cummings, legal representative; Richard Sinden, Cheltenham (GB); Philip Gerdon, Hackettstown, NJ (US); Patrick Jay Lutz, Nazareth, PA (US); Olga Borokhov, Chatham, NJ (US); Steve Finch, Tewkesbury (GB)

(73) Assignees: Lonza Inc., Fair Lawn, NJ (US); Lonza Ltd., Basel (CH); Omnia-Chem Ltd., Darbyshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/121,082

(22) Filed: Apr. 12, 2002

(65) Prior Publication Data

US 2002/0179262 A1 Dec. 5, 2002

Related U.S. Application Data

(63) Continuation of application No. 09/878,125, filed on Jun. 8, 2001, now Pat. No. 6,432,262.

(60) Provisional application No. 60/210,252, filed on Jun. 8, 2000.

(51) Int. Cl.[7] ..... A61K 33/40; C01B 15/00; C01B 15/037

(52) U.S. Cl. ..... 424/613; 423/265; 423/272; 424/616

(58) Field of Search ..... 423/272, 265; 424/613, 616

(56) References Cited

U.S. PATENT DOCUMENTS

| | | | | | |
|---|---|---|---|---|---|
| 825,888 | A | * | 7/1906 | Bloom | 423/272 |
| 3,801,512 | A | * | 4/1974 | Solenberger | 423/272 |
| 4,003,865 | A | | 1/1977 | Nowak et al. | 524/44 |
| 4,016,243 | A | * | 4/1977 | Strong | 423/272 |
| 4,362,706 | A | * | 12/1982 | Willard | 423/272 |
| 4,636,368 | A | * | 1/1987 | Pralus | 423/272 |
| 4,908,456 | A | | 3/1990 | Farina et al. | 548/312 |
| 4,981,662 | A | * | 1/1991 | Dougherty | 423/272 |
| 5,405,862 | A | | 4/1995 | Farina et al. | 514/389 |
| 5,565,109 | A | | 10/1996 | Sweeny | 210/755 |
| 5,728,263 | A | | 3/1998 | Mattila et al. | 162/5 |
| 5,885,412 | A | | 3/1999 | Päärt et al. | 162/5 |
| 6,436,342 | B1 | * | 8/2002 | Petri et al. | 424/750 |

FOREIGN PATENT DOCUMENTS

| | | | |
|---|---|---|---|
| DE | 19529444 | 2/1997 | C02F/1/72 |
| GB | 2269191 | 2/1994 | D21C/9/10 |
| WO | 9500439 | 1/1995 | C01B/15/037 |

OTHER PUBLICATIONS

Method for Controlling Catalase in a Deink Pupl Mill; Bobby Ng, et al.; Tappi Journal, vol. 80; (Apr. 1997); pp. 198–199.

Increasing Bleach Plant Efficiency Through Control of Catalase and Peroxidase; Linda R. Robertson et al., Tappi Journal, vol. 82; (Jun. 1999); (pp. 137–139).

1996 Pulping Conference—"Catalase and Peroxidase Control to Improve Bleach Plant Efficiency"; L.R. Robertson et al.

1996 Recycling Symposium—"Methods for Controlling Catalase in a Deinking Mill"; John D. Kronis et al.

* cited by examiner

*Primary Examiner*—Wayne A. Langel
(74) *Attorney, Agent, or Firm*—Darby & Darby

(57) ABSTRACT

The present invention is a method of stabilizing hydrogen peroxide in an aqueous solution, such as a circulating water slurry, comprising a peroxide, such as hydrogen peroxide. The aqueous solution may include organic matter. The method comprises adding an aldehyde donor, such as a methylolhydantoin, to the solution (or slurry). The inventors have discovered that aldehyde donors significantly reduce the decomposition of hydrogen peroxide by catalase and other peroxide decomposing enzymes, which are often present in recycled paper. As a result, less hydrogen peroxide needs to be added to a solution to effectively bleach organic matter in the solution. Furthermore, aldehyde donors are safe to handle and cost effective. Another embodiment is a method of bleaching recycled papers in a circulating water slurry comprising organic matter. The method comprises adding hydrogen peroxide and an aldehyde donor to the slurry. Yet another embodiment is a method of inhibiting catalase and/or other peroxide decomposing enzymes in an aqueous solution, such as a circulating water slurry, comprising adding an aldehyde donor to the aqueous solution.

36 Claims, No Drawings

ALDEHYDE DONORS FOR STABILIZING PEROXIDES

This is a continuation, of application Ser. No. 09/878,125, filed Jun. 8, 2001, U.S. Pat. No. 6,432,262, and No. 60/210,252, filed June 8, 2000. Each of these prior applications is hereby incorporated herein by reference, in its entirety.

This application claims the benefit of U.S. Patent Application Serial No. 60/210,252, filed Jun. 8, 2000, which is hereby incorporated by reference in its entirety.

FIELD OF THE INVENTION

The present invention relates to the use of aldehyde donors, such as 1,3-bis(hydroxymethyl)-5,5-dimethylhydantoin, to stabilize peroxides in aqueous solutions and in particular circulating water slurries in papermaking applications.

BACKGROUND OF THE INVENTION

The bleaching of wood fibers frequently involves the use of peroxides, such as hydrogen peroxide. Hydrogen peroxide, however, is readily decomposed by catalase, an enzyme often found in recycled water (i.e. water from processing recycled paper). Most aerobic bacteria synthesize peroxide-degrading enzymes (e.g. catalase and peroxidase) as a defense against free-radical-producing peroxides that are formed during cell respiration. In a mill white water environment, temperatures and the availability of nutrients encourage bacterial growth. The presence of hydrogen peroxide stimulates bacteria to generate catalase to destroy it, sometimes enough to hamper or disable a hydrogen peroxide treatment stage. As a result, peroxide stability is limited and bleaching effectiveness is reduced. The conditions of recycled paper processing, deinking and bleaching are especially conducive to enzyme peroxide degradation.

Some of the methods employed to stabilize hydrogen peroxide include biocide treatments (e.g. peracetic acid treatment), use of high hydrogen peroxide dosages and steep bleaching.

U.S. Pat. No. 5,728,263 describes the use of dialdehydes and acetals thereof, such as glutaraldehyde, to inhibit the decomposition of peroxide in the treatment of recycled and other fiber pulps. Hydrogen peroxide stability is enhanced by the addition of glutaraldehyde. Glutaraldehyde, however, has a poor safety profile and high concentrations of it are required to inhibit peroxide decomposition.

U.S. Pat. No. 5,885,412 describes the use of certain hydroxyl amines and alkyl derivatives, including hydroxylammonium sulfate, ascorbic acid and formic acid, that suppress or inhibit hydrogen peroxide degradation by enzymes, such as peroxidases and catalases, during bleaching of cellulose fibers and do not affect microorganisms.

Great Britian Patent Publication No. 2,269,191 describes the use of an organic peracid that has a disinfectant effect on catalase producing microorganisms at neutral or acidic pH.

U.S. Pat. No. 4,908,456 teaches the use of methylolated hydantoin, especially 1,3-dimethylol-5,5-dimethylhydantoin (DMDMH) as an antimicrobial agent.

U.S. Pat. No. 5,405,862 teaches the preparation of low free formaldehyde DMDMH compositions which are used in biocidal effective amounts in any medium in which microbial growth is to be retarded.

There is a need for a method of stabilizing hydrogen peroxide in the presence of catalase and other peroxide degenerating enzymes that is not hazardous.

SUMMARY OF THE INVENTION

The present invention is a method of stabilizing hydrogen peroxide in an aqueous solution, such as a circulating water slurry, comprising a peroxide, such as hydrogen peroxide. The aqueous solution may include organic matter. The method comprises adding an aldehyde donor, such as a methylolhydantoin, to the solution (or slurry). The inventors have discovered that aldehyde donors significantly reduce the decomposition of hydrogen peroxide by catalase and other peroxide decomposing enzymes, which are often present in recycled paper. As a result, less hydrogen peroxide needs to be added to a solution to effectively bleach organic matter in the solution. Furthermore, aldehyde donors are safe to handle and cost effective.

Another embodiment is a method of bleaching recycled papers in a circulating water slurry comprising organic matter. The method comprises adding hydrogen peroxide and an aldehyde donor to the slurry.

Yet another embodiment is a method of inhibiting catalase and/or other peroxide decomposing enzymes in an aqueous solution, such as a circulating water slurry, comprising adding an aldehyde donor to the aqueous solution.

Yet another embodiment is a method of stabilizing a peroxide in an aqueous solution comprising maintaining a peroxide stabilizing effective amount of at least one aldehyde donor in the aqueous solution.

Yet another embodiment is a method of inhibiting catalase and/or other peroxide decomposing enzymes in an aqueous solution, such as a circulating water slurry, comprising maintaining a peroxide decomposing enzyme inhibiting effective amount of at least one aldehyde donor in the aqueous solution.

DETAILED DESCRIPTION OF THE INVENTION

In any identified embodiments, the term "about" means within 50%, preferably within 25%, and more preferably within 10% of a given value or range. Alternatively, the term "about" means within an acceptable standard error of the mean, when considered by one of ordinary skill in the art.

The present invention provides a method of stabilizing a peroxide, such as hydrogen peroxide, in an aqueous solution comprising the peroxide. The method comprises adding to or maintaining an aldehyde donor in the aqueous solution. Generally, the peroxide is added to the solution in the form of a bleaching solution.

The aqueous solution can be (i) a circulating water slurry comprising organic matter or (ii) a slurry dilution water. Generally, a slurry dilution water contains little (<0.2% by weight), if any, organic matter. Slurry dilution waters are frequently added to dilute or form solutions containing organic matter, especially pulp. Furthermore, slurry dilution water is frequently recovered from circulating water slurries containing organic matter by methods known in the art.

The term "aldehyde donor" as used herein is defined as any material which is not an aldehyde but upon aqueous dilution liberates a compound which gives positive reactions with aldehyde identifying reagents, i.e. a compound which can identify aldehyde groups. Generally, the liberated compound has the formula

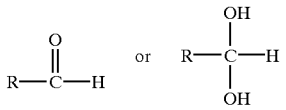

where R is any functional group. In other words, the term "aldehyde donor" includes any compound which is not an aldehyde but when hydrolyzed forms an aldehyde or a compound which gives positive reactions with aldehyde identifying reagents. Examples of aldehyde identifying reagents include, but are not limited to, Benedicts solution, Tollens reagent, and acetyl acetone.

Suitable aldehyde donors include, but are not limited to, imidazolidinyl urea, Quatemium-15, diazolidinyl urea, bromonitropropanediol, methenamine, 5-bromo-5-nitro-1,3-dioxane, sodium hydroxymethylglycinate, 3,5-dimethyl-1,3,5,2H-tetrahydrothiadiazine-2-thione, hexahydro-1,3,5-tris (2-hydroxyethyl)triazine, hexahydo-1,3,5-triethyl-s-triazine, polymethoxy bicyclic oxazolidine, tetrakis (hydroxymethyl) phosphonium sulfate, methylolhydantoins, and any combination of any of the foregoing.

Preferred aldehyde donors include, but are not limited to, methylolhydantoins, such as monomethyloldimethylhydantoins (MMDMHs), dimethyloldimethylhydantoins (DMDMHs), and any combination of any of the foregoing. Examples of methylolhydantoins include, but are not limited to, 1-hydroxymethyl-5,5-dimethylhydantoin (a MMDMH), 3-hydroxymethyl-5,5-dimethylhydantoin (a MMDMH), and 1,3-bis(hydroxymethyl)-5,5-dimethylhydantoin (DMDMH) mixtures (which are available as aqueous solutions under the tradenames Dantogard® and Glydant® from Lonza Inc. of Fair Lawn, N.J.). Other preferred aldehyde donors include, but are not limited to, low free formaldehyde compositions of dimethyloldimethylhydantoin, such as those described in U.S. Pat. No. 5,405,862, which is hereby incorporated by reference. Preferably, the aldehyde donor has a free formaldehyde concentration of less than 0.2% based on 100% total weight of aldehyde donor. Low free formaldehyde compositions reduce workplace exposure risk to formaldehyde. Generally, the weight ratio of methylolhydantoins to peroxide ranges from about 10:1 to about 1:1000.

According to a preferred embodiment, the aldehyde donor is a mixture of 1-hydroxymethyl-5,5-dimethylhydantoin, 3-hydroxymethyl-5,5-dimethylhydantoin, and 1,3-bis (hydroxymethyl)-5,5-dimethylhydantoin. Preferably, the mixture has a free formaldehyde concentration of less than 0.2% by weight, based on 100% total weight of the mixture. An example of a preferred mixture is a 65–70% aqueous solution of MMDMH, DMDMH, and 5,5-dimethylhydantoin (DMH) available under the tradename Dantogard® 2000 from Lonza, Inc of Fair Lawn, N.J.

The aldehyde donor significantly reduces the decomposition rate of hydrogen peroxide by catalase and other peroxide decomposing enzymes. The amount of the aldehyde donor added to the solution is typically sufficient to maintain a peroxide stabilizing effective concentration (i.e. a concentration sufficient to prevent decomposition of the peroxide) and/or a peroxide decomposing enzyme inhibiting effective concentration in the solution (such as a catalase inhibiting concentration). According to a preferred embodiment, the concentration of aldehyde donor maintained in the slurry is less than a microbicidally effective amount. Preferably, the concentration of aldehyde donor maintained in the solution ranges from about 1 to about 1,000 ppm, more preferably from about 30 to about 200 ppm, and most preferably from about 60 to about 120 ppm. According to one embodiment, the concentration of aldehyde donor maintained in the solution ranges from about 1 to about 5000 ppm, from about 100 to about 1000 ppm, from about 250 to about 500 ppm, from about 250 to about 750 ppm, from about 50 to about 500 ppm, from about 50 to about 750 ppm, from about 100 to about 200 ppm, or from about 200 to about 400 ppm.

Although many of the aldehyde donors identified above are also known biocides, their concentration in the solution can be less than that necessary to have a significant biocidal effect, i.e. they generally provide less than a 2 log reduction in the microorganism population in short contact time applications (e.g. 3 hours or less). The term "log reduction in the microorganism population" refers to the difference between the logarithm (base 10) of the microorganism count of an untreated substrate after a given contact time, such as 3 hours or less, and the logarithm of the microorganism count of an identical substrate treated with an aldehyde donor after the same contact time. According to one embodiment, the aldehyde donor causes a log reduction in microorganism population of less than 0.5 or 1.

A biocidal concentration of one or more biocides may also be added to or maintained in the solution. Suitable biocides include, but are not limited to, those described in Great Britain Patent Publication No. 2,269,191 ,which is hereby incorporated by reference. Other suitable biocides include, but are not limited to, thiocarbamates, such as sodium dimethyl dithiocarbamate; glutaraldehyde; dibromo nitrile propionamide (DBNPA); bromnitropropanediol; tetrakis (hydroxymethyl) phosphonium sulfate; bromonitrostyrene (BNS); benzisothiazolones; methylene bis(thiocyanate); 2-mercaptobenzothiazole (MBT); isothiazolines, including 5-chloro-2-methyl-4-isothiazolin-3 -one (CMI), 2-methyl-4-isothiazolin-3 -one (MI), octyl-4-isothiazolin-3-one, and mixtures thereof; bistrichloromethylsulfone (BTCMS); quaterary ammonium compounds, such as alkyldimethylbenzyl ammonium chlorides and dialkydimethyl ammonium chlorides; 2-bromo-4-hydroxyacetophenone (BHAP); and 5-oxo-3,4-dichloro-1,2-dithiol; and any combination of any of the foregoing.

Peracetic acid may be added to the solution to kill or inhibit the growth of microorganisms and/or to bleach any organic matter in the solution. Therefore, a microbicidally effective amount and/or a bleaching effective amount of peracetic acid may be added to or maintained in the solution.

The aldehyde donor may be added directly to the solution (e.g. slurry or slurry dilution water) or bleaching solution as a solid or liquid. Preferably, the aldehyde donor is added to the solution as a liquid. For example, the aldehyde donor may be added as an aqueous mixture. The concentration of aldehyde donor in such an aqueous mixture typically ranges from about 5 to about 95% by weight and preferably from about 20 to about 75% by weight, based upon 100% weight of total mixture. The aldehyde donor may be added before, simultaneously with, or after the hydrogen peroxide is added to the aqueous solution, or alternatively to the peroxide bleaching solution itself.

The hydrogen peroxide may be added alone or as a mixture with one or more biocides to the solution (or slurry) or peroxide bleaching solution. For example, a mixture of hydrogen peroxide and peracetic acid may be added to the solution (or slurry) or peroxide bleaching solution.

According to one embodiment, a blend of one or more aldehyde donors, CMI, and MI is added to the solution (or slurry). The blend may optionally contain isothiazoline stabilizers as known in the art. A preferred blend includes CMI, MI, and at least one of MMDMH and DMDMH.

According to another embodiment, a blend of one or more aldehyde donors and a benzisothiazolinone is added to the solution (or slurry). A preferred blend includes benzisothiazolinone and at least one of MMDMH and DMDMH. Such aldehyde donor blends are described in U.S. Pat. Nos. 6,121,302 and 6,114,366, which are incorporated herein by reference.

The concentration of hydrogen peroxide added to or maintained in the solution is typically a bleaching effective concentration in the solution. The concentration of hydrogen peroxide maintained in the solution preferably ranges from about 1 to about 50,000 ppm, more preferably ranges from about 10 to about 10,000 ppm, and most preferably ranges from about 100 to about 1,000 ppm.

The solution may be, for example, a pulp slurry, a papermaking slurry, a mineral slurry or white water. White water is generally separated liquid that is re-circulated to a preceding stage of a papermaking process, especially to the first disintegration stage, where paper, water and chemicals are mixed.

Generally, a mineral slurry comprises of from about 50 to about 80% by weight of mineral matter, such as, but not limited to, calcium carbonate or clay. The mineral slurry may also contain an organic dispersing agent. Preferred organic dispersing agents include, but are not limited to, polyacrylates.

Typical pulp slurries in paper applications contain from about 0.2 to about 18% by weight of organic matter, based upon 100% total weight of slurry. The organic matter is typically comprised of wood fiber (or pulp) and adjuvants, such as sizing and starch. Generally, the organic matter comprises from about 90 to about 99% by weight of wood fiber (or pulp), based upon 100% total weight of organic matter. According to a preferred embodiment, the wood fiber is at least partially derived from recycled paper.

The pulp slurry may also contain other adjuvants known in the art. Examples of such adjuvants include, but are not limited to, slimicides; sodium hydroxide (or other caustic); peroxide stabilizers, such as sodium silicate, magnesium sulfate, and polyphosphates; chelating agents, such as EDTA; fatty acids; and combinations thereof.

Generally, the pH of the solution ranges from about 7 to about 13 and preferably from about 8 to about 11. In another embodiment, the pH of the solution ranges from about 4 to about 13, preferably from about 7 to about 12, and more preferably from about 8 to about 11.

The following examples are intended to describe the present invention without limitation.

EXAMPLE 1

Process waters from a papermaking facility which uses recycled fibers were collected during a bleaching stage and allowed to stand for 2 hours to achieve total depletion of the hydrogen peroxide in the process waters.

Into five separate Pyrex beakers were placed 400 ml of the process water. One was retained as a control. 150 and 300 ppm of an aqueous solution containing 40% by weight of 1,3-bis(hydroxymethyl)-5,5-dimethylhydantoin (DMDMH) (Dantogard®) were added to two beakers for a total concentration of 60 ppm and 120 ppm of DMDMH, respectively. On an equivalent aldehyde basis, this corresponds to 0.65 mEq/l and 1.30 mEq/l, respectively. 150 and 300 ppm of an aqueous solution containing 55% by weight of glutaraldehyde were added to the remaining two beakers for a total concentration of 83 ppm and 166 ppm of glutaraldehyde, respectively. On an equivalent aldehyde basis, this corresponds to 1.66 mEq/l and 3.32 mEq/l, respectively. The samples were placed in a controlled water bath at 45° C. and stirred with a magnetic stirrer set on slow agitation.

To all the test samples, a sufficient volume of a 1% (by weight) hydrogen peroxide ($H_2O_2$) aqueous solution was added to achieve a concentration of 20–25 ppm of hydrogen peroxide in the samples. At regular time intervals, over a 45 minute period, aliquots were removed and analyzed for peroxide residual (i.e. the concentration of hydrogen peroxide) using a thiosulfate titration kit (HACH Test Kit, Model HYP-1, available from Hach Company of Loveland, Colo.). The results, shown in Table 1, correlate to the amount of peroxide present at the specific time interval, expressed as ppm of hydrogen peroxide.

TABLE 1

| | $H_2O_2$ Stabilization by DMDMH and Glutaraldehyde (expressed as ppm $H_2O_2$) | | | | |
|---|---|---|---|---|---|
| Time (min) | Control | DMDMH (60 ppm) | DMDMH (120 ppm) | Glutaraldehyde (83 ppm) | Glutaraldehyde (166 ppm) |
| 0 | 25 | 25 | 26 | 25 | 26 |
| 10 | 22 | 24 | 24 | 24 | 24 |
| 15 | 21 | 23 | 23 | 22 | 21 |
| 20 | 19 | 22 | 20 | 20 | 19 |
| 30 | 15 | 18 | 18 | 16 | 17 |
| 40 | 13 | 16 | 17 | 14 | 15 |
| 45 | 10 | 15 | 16 | 12 | 13 |

The results show that DMDMH provides superior peroxide stabilization compared to glutaraldehyde. On a ppm product basis, the DMDMH surpassed the performance of the glutaraldehyde. See Table 1. DMDMH surpasses the performance of glutaraldehyde when added at 38% lower concentrations. When considered on a molar aldehyde basis, it is demonstrated that DMDMH surpasses the performance of glutaraldehyde when added at a concentration 73% lower in aldehyde equivalents.

EXAMPLE 2

DMDMH hydrogen peroxide stabilization was demonstrated in a sample of white water obtained from a paperboard mill using recycled paper (50% mix, 15% corrugated, 15% news, and 20% other) as follows. The white water sample was diluted with 10 parts of sterilized tap water for every part of white water. Into three separate Pyrex° beakers, 100 ml of the diluted white water was added. One beaker was retained as a control. 250 and 500 ppm of an aqueous solution containing 40% by weight of DMDMH, available as Dantogard® from Lonza Inc., (i.e. 100 ppm of DMDMH and 200 ppm of DMDMH) were added to the remaining two beakers, respectively. The solutions were tested at 37° C. and a pH of 7.8. Hydrogen peroxide was added to the white water in quantities sufficient to achieve a concentration of 300 ppm $H_2O_2$. Aliquots were taken at the indicated times and analyzed for residual peroxide with a thiosulfate titration kit (Hach Test Kit, Model HYP-1). The results are shown in Table 2 as ppm $H_2O_2$.

TABLE 2

| Time (minutes) | Peroxide Residual (ppm $H_2O_2$) Control | Dantogard® 250 ppm | Dantogard® 500 ppm |
|---|---|---|---|
| 0 | 300 | 300 | 300 |
| 10 | 136 | 160 | 180 |
| 20 | 70 | 94 | 127 |
| 30 | 42 | 68 | 97 |

Dantogard® provided significant hydrogen peroxide stabilization as shown in Table 2. After 30 minutes elapsed time, hydrogen peroxide residuals in the sample treated with 500 ppm Dantogard® were more than twice that in the untreated control.

EXAMPLE 3

The biocidal efficacy of Dantogard® at 250 and 500 ppm (i.e. 100 and 200 ppm of DMDMH) was determined as follows. 50 ml of the undiluted white water sample of Example 2 was treated with 250 and 500 ppm Dantogard®. The test water temperature was 37° C. and the pH was ~7.0.

Microorganism counts were performed after 3 hours contact time using the tryptone glucose extract agar pour plate methodology described in the American Society for Testing and Materials (ASTM) E 1839–96, "Standard Test Method for Efficacy of Slimicides for the Paper Industry—Bacterial and Fungal Slime".

The microorganism count values were then converted to their corresponding log value. The log microbial population reduction values were calculated by subtracting the log of the microorganism count for the respective Dantogard® sample from the log of the microorganism count for the control. The results are shown in Table 3.

Microorganism count reductions of only 0.06 and 0.23 log were observed for Dantogard® concentrations of 250 and 500 ppm, respectively.

TABLE 3

| White Water Sample | Microorganism Count (cfu/ml) | Log microbial population reduction | Biocidal efficacious according to ASTM E-1839-96 criteria* |
|---|---|---|---|
| Untreated Control | $1.3 \times 10^8$ | — | — |
| 250 ppm Dantogard® | $1.2 \times 10^8$ | 0.06 | No |
| 500 ppm Dantogard® | $7.9 \times 10^7$ | 0.23 | No |

*-The ASTM E 1839-96 method indicates that effective slimicides yield a 2 log reduction in the microorganism concentration after the specified 3 hour contact time.

EXAMPLE 4

Hydrogen peroxide stabilization was demonstrated in another white water sample as follows.

Into three seperate beakers were placed 100 ml of a white water sample obtained from a tissue and towel mill using recycled newsprint as a pulp feed stock. The recycled feed stock had been subject to deinking and peroxide bleaching in the tissue and towel mill. One beaker was retained as a control. 250 and 500 ppm of Dantogard® were added to the other two beakers, respectively.

The test temperature was 32° C. and the pH was 7.6. 30 ppm of hydrogen peroxide was added to the samples. Aliquots were taken at the indicated times and analyzed for residual peroxide using a thiosulfate titration kit (Hach Test Kit, Model HYP-1). The results are shown in Table 4 below.

TABLE 4

| Time (minutes) | Peroxide Residual (ppm $H_2O_2$) Control | 250 ppm Dantogard® | 500 ppm Dantogard® |
|---|---|---|---|
| 0 | 30 | 30 | 30 |
| 20 | 14 | 21 | 22 |
| 40 | 8 | 15 | 16 |

Dantogard® provided significant hydrogen peroxide stabilization as shown in Table 4. After 40 minutes elapsed time, the concentration of hydrogen peroxide in the sample with 500 ppm Dantogard® was twice that of the untreated control.

EXAMPLE 5

The Dantogard® concentrations found to provide hydrogen peroxide stabilization in Example 4 (250–500 ppm) were again found to be below the concentrations required to provide significant biocidal efficacy according to ASTM E 1839–96.

50 ml of an undiluted white water sample of Example 4 was treated with Dantogard® at concentrations of 250 and 500 ppm (100 and 200 ppm DMDMH). The test water temperature was 32° C., and the pH was 7.6.

Microorganism counts were performed after 3 hours contact time using the tryptone glucose extract agar pour plate methodology as described in ASTM E 1839–96.

The microorganism count values were then converted to their corresponding log value. The log microbial population reduction values were calculated by subtracting the log of the microorganism count for the Dantogard® sample from the log of the microorganism count for the control. The results are shown in Table 5.

TABLE 5

| Agent | Microorganism Count (cfu/ml) | Log Microbial Population Reduction | Biocidal efficacious by ASTM E 1839-96 criteria* |
|---|---|---|---|
| Control time zero | $8.0 \times 10^6$ | — | — |
| Control | $1.1 \times 10^7$ | 0 | — |
| Dantogard® 250 ppm | $5.1 \times 10^6$ | 0.37 | No |
| Dantogard® 500 ppm | $1.9 \times 10^6$ | 0.80 | No |

*ASTM E 1839-96 indicates that effective slimicides yield a 2 log reduction in the microorganism concentration after the specified 3 hour contact time.

EXAMPLE 6

Direct inhibition of catalase by DMDMH solutions was demonstrated by monitoring catalase promoted hydrogen peroxide decomposition in sterile media.

Hydrogen peroxide solutions containing 470 ppm active peroxide in sterile Butterfield's phosphate buffer (pH=7.0) were treated with 1.2 units of catalase (*A. niger* available from Sigma Aldrich of St. Louis, Mo. (C-3515)) alone or with 263 or 526 ppm of Dantogard® 2000, available from Lonza Inc. of Fair Lawn, N.J., or 526 ppm of an aqueous 49% glutaraldehyde solution. Dantogard® 2000 is a 65% aqueous mixture of DMDMH, MMDMH and DMH having a minimal free formaldehyde concentration. The peroxide decomposition rate was monitored during the decrease in peroxide concentration from 390 to 350 ppm by ultraviolet absorbance at 240 nm. The temperature was 23° C. The results are shown Table 6.

TABLE 6

| Sample | Peroxide Decomposition Rate (ppm/sec) | Normalized Decomposition Rate |
|---|---|---|
| Control | 0.230 | 1.00 |
| 263 ppm Dantogard® 2000 | 0.143 | 0.62 |
| 526 ppm Dantogard® 2000 | 0.073 | 0.32 |
| 526 ppm glutaraldehyde (49%) | 0.230 | 1.0 |

Dantogard® 2000 provided significant catalase inhibition. 263 ppm of Dantogard® 2000 decreased the hydrogen peroxide decomposition rate to 62% of that of the untreated control. 526 ppm of Dantogard® 2000 decreased the hydrogen peroxide decomposition rate to 32% of that of the untreated control.

EXAMPLE 7

Direct inhibition of catalase by DMDMH solutions was demonstrated by monitoring catalase promoted hydrogen peroxide decomposition in a pH 9.2 borate buffer.

Hydrogen peroxide solutions containing 450 ppm active peroxide in a 0.57% borax buffer (pH=9.2) were treated with 1.2 units catalase (*A. niger* derived Sigma Aldrich C-3515) in the presence and absence of Dantogard® (Lonza Inc. of Fairlawn, N.J.). The peroxide decomposition rate was monitored during the decrease in peroxide concentration from 390 to 350 ppm by ultraviolet absorbance at 240 nm. The temperature was 23° C. The results are shown Table 7.

TABLE 7

| | Peroxide Decomposition Rates | |
|---|---|---|
| Product | Rate (ppm/sec) | Normalized Decomposition Rate |
| Control | 0.106 | 1.00 |
| Dantogard 500 ppm | 0.051 | 0.48 |

Dantogard® provided significant catalase inhibition. A concentration of 500 ppm decreased the hydrogen peroxide decomposition rate to 48% of that of the untreated control.

All patents, publications, applications, and test methods mentioned above are hereby incorporated by reference. Many variations of the present matter will suggest themselves to those skilled in the art in light of the above detailed description. All such obvious variations are within the patented scope of the appended claims.

What is claimed is:

1. A method of inhibiting peroxide decomposing enzymes in an aqueous solution comprising hydrogen peroxide, the method comprising the step of maintaining an effective amount of at least one aldehyde donor in the aqueous solution to prevent decomposition of the hydrogen peroxide, wherein the aldehyde donor is selected from the group consisting of imidazolidinyl urea, Quaternium-15, diazolidinyl urea, bromonitropropane diol, methenamine, 5-bromo-5-nitro-1,3-dioxane, sodium hydroxymethylglycinate, 3,5-dimethyl-1,3,5,2H-tetrahydrothiadiazine-2-thione, hexahydro-1,3,5-tris(2-hydroxyethyl)triazine, hexahydo-1,3,5-triethyl-s-triazine, polymethoxy bicyclic oxazolidine, methylolhydantoins, tetrakis (hydroxymethyl) phosphonium sulfate and any combination of any of the foregoing.

2. The method of claim 1, wherein the aldehyde donor is selected from the group consisting of 1-hydroxymethyl-5,5-dimethylhydantoin, 3-hydroxymethyl-5,5-dimethylhydantoin, 1,3-bis hydroxymethyl)-5,5-dimethylhydantoin, and any combination of any of the foregoing.

3. The method of claim 2, further comprising maintaining a biocidal concentration of one or more biocides in the aqueous solution.

4. The method of claim 3, wherein the biocide is an isothiazoline.

5. The method of claim 4, wherein the isothiazoline is a mixture of 5-chloro-2-methyl isothiazolin-4-one and 2-methyl-4 isothiazolin-3-one.

6. The method of claim 4, wherein the isothiazoline is benzisothiazolinone.

7. The method of claim 2, wherein the aldehyde donor is a mixture of 1-hydroxymethyl-5,5-dimethylhydantoin, 3-hydroxymethyl-5,5-dimethylhydantoin, and 1,3-bis (hydroxymethyl)-5,5-dimethylhydantoin and 5,5-dimethylhydantoin.

8. The method of claim 7, wherein the mixture has a free formaldehyde concentration of less than 0.2% by weight, based on 100% weight of the mixture.

9. The method of claim 2, wherein the aldehyde donor is 1,3-bis(hydroxymethyl)-5,5-dimethylhydantoin.

10. The method of claim 2, wherein the aqueous solution further comprises peracetic acid.

11. The method of claim 2, wherein the aqueous solution further comprises a biocide.

12. The method of claim 2, wherein the peroxide decomposing enzymes comprise catalase.

13. The method of claim 2, wherein the concentration of aldehyde donor maintained in the aqueous solution is a peroxide stabilizing effective amount.

14. The method of claim 2, wherein the concentration of aldehyde donor maintained in the aqueous solution is from about 1 to about 5,000 pm.

15. The method of claim 2, wherein the concentration of aldehyde donor maintained in the aqueous solution is from about 100 to about 200 pm.

16. The method of claim 2, wherein the concentration of aldehyde donor in the aqueous solution is from about 60 to about 120 ppm.

17. The method of claim 2, wherein the concentration of hydrogen peroxide maintained in the aqueous solution is a bleaching effective amount.

18. A method of inhibiting peroxide decomposing enzymes in an aqueous solution comprising hydrogen peroxide, the method comprising the step of maintaining an effective amount of at least one aldehyde donor in the aqueous solution to prevent decomposition of the hydrogen peroxide, wherein the aldehyde donor is not a dialdehyde or acetal thereof.

19. The method of claim 18, further comprising maintaining a biocidal concentration of one or more biocides in the aqueous solution.

20. The method of claim 19, wherein the biocide is an isothiazoline.

21. The method of claim 20, wherein the isothiazoline is a mixture of 5-chloro-2-methyl isothiazolin-4-one and 2-methyl-4 isothiazolin-3-one.

22. The method of claim 20, wherein the isothiazoline is benzisothiazolinone.

23. The method of claim 18, wherein the concentration of aldehyde donor maintained in the aqueous solution is from about 1 to about 5,000 ppm.

24. The method of claim 23, wherein the concentration of aldehyde donor maintained in the aqueous solution is from about 100 to about 200 ppm.

25. The method of claim 23, wherein the concentration of aldehyde donor in the aqueous solution is from about 60 to about 120 ppm.

26. The method of claim 18, wherein the concentration of aldehyde donor maintained in the aqueous solution is a peroxide stabilizing effective amount.

27. The method of claim 18, wherein the concentration of hydrogen peroxide maintained in the aqueous solution is a bleaching effective amount.

28. The method of claim 18, wherein the aqueous solution further comprises peracetic acid.

29. The method of claim 18, wherein the aqueous solution further comprises a biocide.

30. The method of claim 18, wherein the peroxide decomposing enzymes comprise catalase.

31. A method of inhibiting peroxide decomposing enzymes in an aqueous solution comprising a peroxide, the method comprising maintaining a peroxide decomposing enzyme inhibiting effective amount of at least one aldehyde donor in the aqueous solution, wherein the aldehyde donor is not a dialdehyde or acetal thereof.

32. The method of claim 31, wherein the aldehyde donor is selected from the group consisting of imidazolidinyl urea, Quaternium-15, diazolidinyl urea, bromonitropropane diol, methenamine, 5-bromo-5-nitro-1,3-dioxane, sodium hydroxymethylglycinate, 3,5-dimethyl-1,3,5,2H-tetrahydrothiadiazine-2-thione, hexahydro-1,3,5-tris(2-hydroxyethyl)triazine, hexahydo-1,3,5-triethyl-s-triazine, polymethoxy bicyclic oxazolidine, methylolhydantoins, tetrakis (hydroxymethyl) phosphonium sulfate and any combination of any of the foregoing.

33. The method of claim 32, wherein the aldehyde donor is selected from the group consisting of 1-hydroxymethyl-5,5-dimethylhydantoin, 3-hydroxymethyl-5,5-dimethylhydantoin, 1,3-bis(hydroxymethyl)-5,5-dimethylhydantoin, and any combination of any of the foregoing.

34. A method of stabilizing hydrogen peroxide in an aqueous solution containing peroxide decomposing enzymes and hydrogen peroxide, comprising the step of maintaining an effective amount of at least one aldehyde donor in the aqueous solution to prevent decomposition of the hydrogen peroxide, wherein the aldehyde donor is not a dialdehyde or acetal thereof.

35. The method of claim 34, wherein aldehyde donor is selected from the group consisting of imidazolidinyl urea, Quaternium-5, diazolidinyl urea, bromonitropropane diol, methenamine, 5-bromo-5-nitro-1,3-dioxane, sodium hydroxymethylglycinate, 3,5-dimethyl-1,3,5,2H-tetrahydrothiadiazine-2 thione, hexahydro-1,3,5-tris(2-hydroxyethyl)triazine, hexahydo-1,3,5-triethyl-s-triazine, polymethoxy bicyclic oxazolidine, methylolhydantoins, tetrakis (hydroxymethyl) phosphonium sulfate and any combination of any of the foregoing.

36. The method of claim 35, wherein the aldehyde donor is selected from the group consisting of 1-hydroxymethyl-5,5-dimethylhydantoin, 3-hydroxymethyl-5,5-dimethylhydantoin, 1,3-bis(hydroxymethyl)-5,5-dimethylhydantoin, and any combination of any of the foregoing.

* * * * *